United States Patent [19]

Murase

[11] Patent Number: 4,678,441

[45] Date of Patent: Jul. 7, 1987

[54] SYSTEM FOR DISCHARGING WATER FROM CRANK CHAMBER

[75] Inventor: Masaaki Murase, Kakogawa, Japan

[73] Assignee: Kawasaki Jukogyo Kabushiki Kaisha, Kobe, Japan

[21] Appl. No.: 820,176

[22] Filed: Jan. 21, 1986

[30] Foreign Application Priority Data

Jan. 24, 1985 [JP] Japan ..... 60-11644

[51] Int. Cl.[4] ..... B63H 21/10

[52] U.S. Cl. ..... 440/88; 114/197; 123/73 R

[58] Field of Search ..... 440/88, 89, 900; 123/73 R, 73 A; 114/184 R, 197

[56] References Cited

U.S. PATENT DOCUMENTS 3,128,748 4/1964 Goggi ..... 123/73 R 3,859,967 1/1975 Turner et al. ..... 123/73 A 4,217,846 8/1980 Wight ..... 114/197

4,461,250 7/1984 Mohr ..... 123/73 R

*Primary Examiner*—Joseph F. Peters, Jr.

*Assistant Examiner*—Jesûs D. Sotelo

*Attorney, Agent, or Firm*—Leydig, Voit & Mayer

[57] ABSTRACT

A system for discharging water from a crank chamber of a two-cycle engine of a compression-type crank chamber including a water discharge passageway for connecting a bottom portion of the crank chamber with an outside area, a first valve and a second valve mounted in the water discharge passageway, and an operating member for manually opening and closing the second valve. The second valve is located downstream of the first valve and the first valve is adapted to be brought to an open position by a positive pressure in the crank chamber.

5 Claims, 4 Drawing Figures

SYSTEM FOR DISCHARGING WATER FROM CRANK CHAMBER

BACKGROUND OF THE INVENTION

This invention relates to a system for discharging water from a crank chamber of a compression-type crank chamber two-cycle engine when the water is collected therein.

One type of small watercrft adapted to be driven by a driver in a standing or sitting position for movement on the water may be constructed such that it can be readily righted when it turns over laterally. When it turns over, water will enter the crank chambers of a two-cycle engine of the compression-type crank chamber, i.e., crankcase-scavenged-type through the suction port. When the engine is constructed such that water is injected into the exhaust muffler to silence engine noise, the water might flow backwardly and enter the crank chambers through the combustion chambers. If the water enters the crank chambers, the engine would stop operating and difficulty would be experienced in restarting it.

When this happens, it has hitherto been usual practice to discharge the water collected in the crank chambers by bringing the engine to a tilting position to remove the ignition plug and turning the starter after bringing the engine to an upside down position. This process is troublesome and time-consuming, making it impossible to restart the engine quickly.

SUMMARY OF THE INVENTION

This invention has the purpose of obviating the aforesaid disadvantages of the prior art. Accordingly, the invention has as its object the provision of a system for discharging water from the crank chambers of a two-cycle engine of a compression-type crank chamber capable of readily discharging water from the crank chambers and allowing the engine to be restarted quickly.

To accomplish the aforesaid object, the invention provides a system for discharging water comprising a water discharge passage way for connecting a bottom portion of the crank chambers with an outside area, a first valve mounted in the water discharge passageway and adapted to be brought to an open position by a positive pressure in a crank chamber, a second valve mounted in the water discharge passageway, and an operating member for manually opening and closing the second valve.

DESCRIPTION OF THE PREFERRED EMBODIMENT

Figure 1:
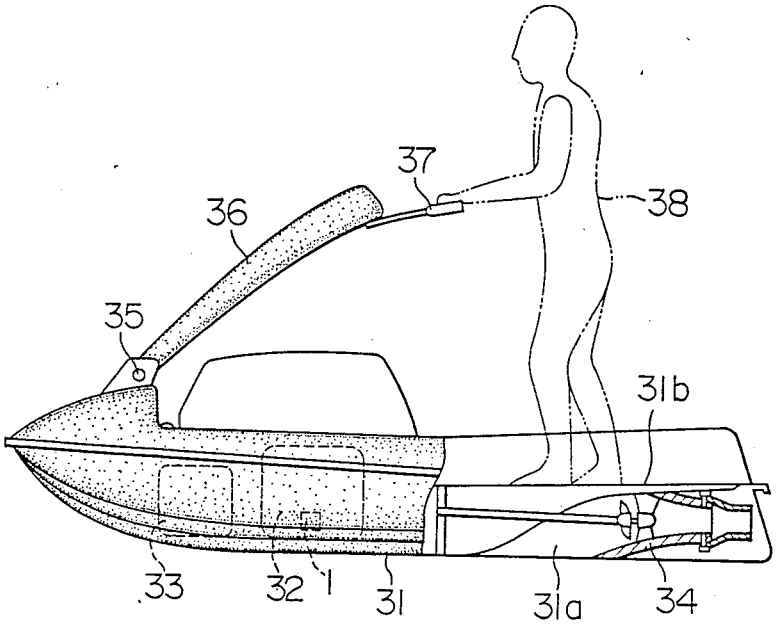
FIG. 1 is a side view, with certain parts being cut out, of a small watercraft provided with a system for discharging water comprising one embodiment of the invention.
Figure 2:
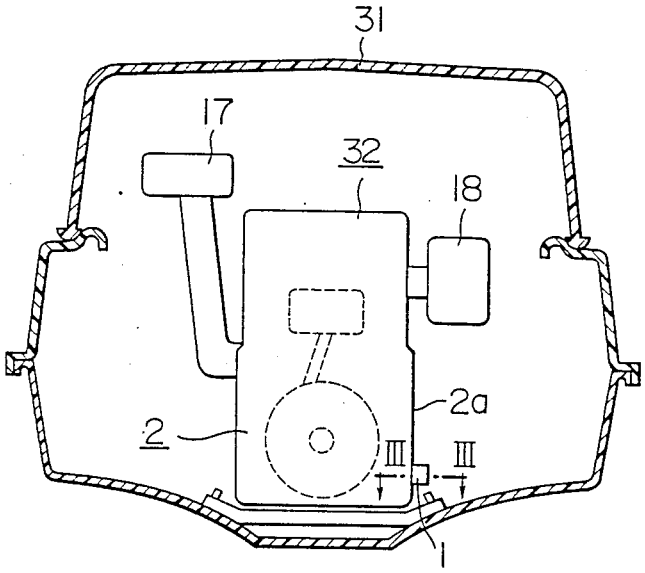
FIG. 2 is a substantially sectional view of the small watercraft shown in FIG. 1, showing the vicinity of the engine.

FIG. 1 is a side view, with certain parts being cut out, showing the general construction of a small watercraft provided with the water discharge system comprising one embodiment of the invention, and FIG. 2 is a substantially sectional view of the small watercraft shown in FIG. 1.

Referring to FIG. 1, a body 31 of the small watercraft formed of fiber-reinforced plastic material has mounted therein a two-cycle engine 32 of a compression-type crank chamber and a fuel tank 33. Water jet propulsion means 34 mounted in a duct section 33 in a rear portion of the body 31 is driven by the engine 32 to provide thrust. A handle pole 36 is connected through a pivot shaft 35 to an upper portion of the body 31 for vertical pivotal movement and has coupled to its rear end a handle bar 37 that can be moved to left and right for steering the watercraft. A driver 38 grips the handle bar 37 to drive the watercraft while standing on a floor **31*b* of the body 31 or sitting thereon. Cooling water is supplied to a muffler 18 (see FIG. 2) after cooling the engine 32**.

The small watercraft of the aforesaid construction is provided with valve means 1 located in a lower portion of a side wall **2*a* of the crank chambers 2, as shown in FIG. 2, to cope with the collection of water in the crank chambers 2 that would enter the crank chambers 2** when the watercraft overturns laterally.

Figure 3:
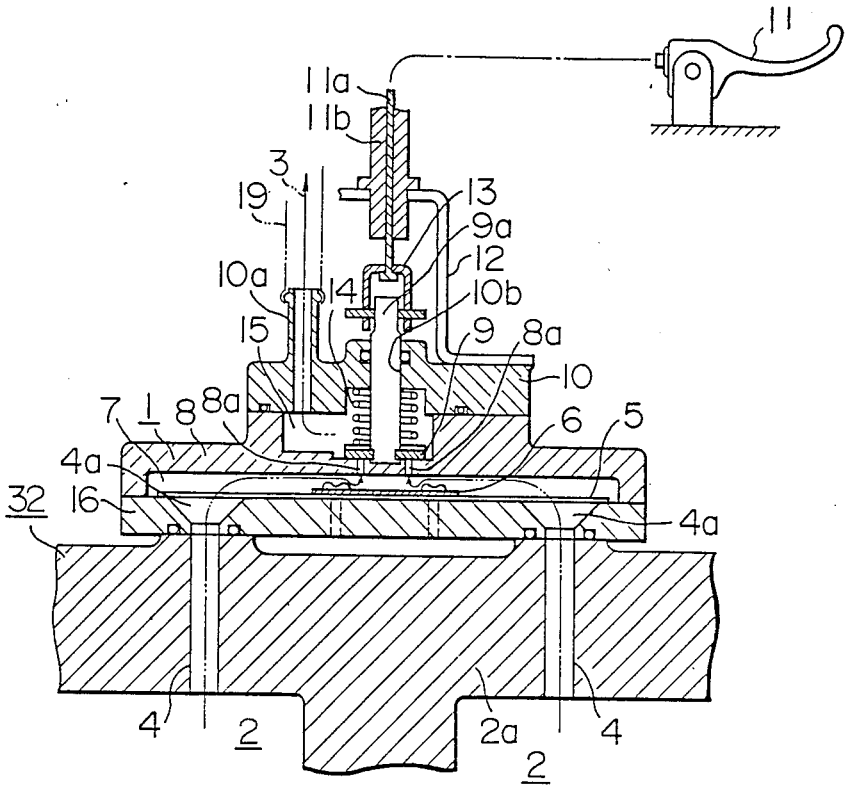
FIG. 3 is a sectional view, on an enlarged scale, taken along the line III—III in FIG. 2.
Figure 4:
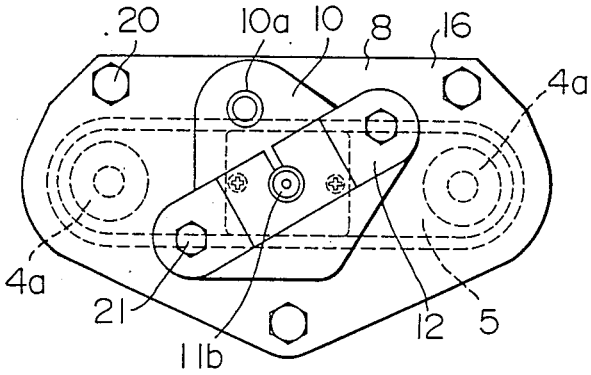
FIG. 4 is a substantially side view of the valve means.

FIG. 3 is a sectional view, on an enlarged scale, taken along the line III—III in FIG. 2, and FIG. 4 is a substantially side view of the valve means 1. In FIG. 3, the engine 32 is a two-cylinder engine and the crank chambers 2 are two in number. Water discharge ducts 4 constituting part of a water discharge passgeway 3 communicating bottom portions of the crank chambers 2 with an outside area are formed in the side wall **2*a* of the crank chambers 2 and a support plate 16 for the valve means 1 secured to the side wall 2*a*. A reed valve 5 serving as a first valve of the valve means 1 secured to the support plate 16 by a fixture 6 is located above funnel-shaped discharge openings 4*a* of the discharge ducts 4 to close and open the discharge openings 4*a*, as shown in FIG. 4**.

Referring to FIG. 4, a cover member 8 fitted to the support plate 16 and covering the discharge side openings **4*a* of the water discharge ducts 4 and the reed valve 5 is formed with a space 7 permitting the reed valve 5 to move between an open position and a closing position. The cover member 8 is formed with duct portions 8*a* constituting part of the water discharge passageway 3 which are adapted to be opened and closed by a second valve 9 of the valve means 1 mounted in the passageway downstream of the first valve 5, which second valve 9 is moved by a rod 9*a*** as the latter moves vertically.

Fitted to the cover member 8 for the water discharge ducts 4 is another cover member 10 which is formed with a discharge port **10*a* constituting part of the water discharge passageway 3. A pipe 19 constituting part of the water discharge passageway 3 is connected to the discharge port 10*a* and includes an upper end portion located inside or outside the body 31. The cover member 10 is formed with a bore 10*b* for receiving the rod 9*a* and has attached thereto a holder 12 for supporting a wire 11*a* for moving the rod 9*a* vertically. The wire 9*a* is connected at one end thereof to a lever 11 serving as an operating member and at an opposite end to the rod 9*a* via a connector 13**.

As shown in FIG. 4, the support plate 16 and cover member 8 are bolted to the side wall **2*a* as indicated at 20 (see FIG. 3), and the cover member 10 is bolted together with the holder 12 to the cover member 8 as indicated at 21. the operating lever 11 shown in FIG. 3 is attached to an outer surface of the handle bar 37 or body 31 shown in FIG. 1**.

As shown in FIG. 3, the second valve 9 is urged by the biasing force of a spring 14 and normally closes the duct portions 8*a* even if a positive pressure prevails in the crank chambers 2. When the operating lever 11 is actuated, the rod 9*a* moves in a recess 15 formed in the cover member 10 against the biasing force of the spring 14, to thereby open the duct portions 8*a*.

Operation of the system for discharging water from the crank chambers 2 constructed as described hereinabove will be described.

Referring to FIG. 3, pulsating pressures or positive and negative pressures are produced in the crank chambers upon an engine starter, not shown, being turned by the driver 38. If the operating lever 11 is pulled at this time, then the second valve 9 opens the duct portions 8*a* while the first valve 5 is operating and performs the operation of opening the discharge openings 4*a* under the influence of the positive pressure in the crank chambers 2 and closing same under the influence of the negative pressure therein. By this operation, water entering through an air cleaner 17 or muffler 18 (see FIG. 2) and collected in the crank chambers 2 is discharged therefrom via the water discharge ducts 4, space 7, duct portions 8*a*, space 15, discharge port 10*a* and pipe 19 into or out of the body 31. The water discharged into the body 31 is released therefrom by means of a bilge discharge device, not shown, which utilizes a negative pressure produced by the water jet propulsion means 34.

From the foregoing description, it will be appreciated that the present invention enables the water collected in the crank chambers to be readily discharged therefrom without requiring to remove the engine from the position in which it is supported, thereby enabling the engine to be restarted quickly. According to the invention, the positive pressure in the crank chambers is utilized for discharging the water from the crank chambers, and no means, such as a pump, is needed to perform the operation of discharging the water from the crank chambers 2. Thus, the engine can be simplified in construction and its reliability can be increased.

What is claimed is:

1. A system for discharging water from a crank chamber of a compression-type crank chamber two-cycle engine comprising:

a water discharge passageway for connecting a bottom portion of the crank chamber with an outside area;

valve means for opening and closing said passageway for allowing discharge of water accumulated in the crank chamber upon operation of a piston of the engine to create positive and negative pressures in the crank chamber while permitting normal operation of the engine with the crank chamber sealed including a first pressure-responsive valve mounted in said water discharge passageway and adapted to be brought to an open position to allow discharge of water through said passageway from the crank chamber by a positive pressure in the crank chamber produced by operation of the piston and adapted to be brought to a closed position to seal the crank chamber by a negative pressure in the crank chamber produced by operation of the piston;

a second valve mounted in said water discharge passageway for operation between open and closed positions; and a manually operated member for manually opening and closing said second valve while said first valve is operating to allow discharge of water via said first valve through the passageway when the first valve is in an open position.

2. A system for discharging water from a crank chamber of a two-cycle engine as claimed in claim 1 wherein said second valve is located downstream of said first valve.

3. A system for discharging water from a crank chamber of a two-cycle engine as claimed in claim 1 wherein said first valve is a reed valve.

4. A system for discharging water from a crank chamber of a two-cycle engine as claimed in claim 3 wherein the engine has two crank chambers and said reed valve includes two valve elements in respective passageway sections connected to the crank chambers, respectively.

5. A system for discharging water from a crank chamber of a two-cycle engine as claimed in claim 1 wherein said second valve is biased by a spring to a closed position.

* * * * *